US005534837A

United States Patent [19]

Brandt

[11] Patent Number: 5,534,837

[45] Date of Patent: Jul. 9, 1996

[54] ORTHOGONAL-FIELD ELECTRICALLY VARIABLE MAGNETIC DEVICE

[75] Inventor: Randy L. Brandt, Orange, Calif.

[73] Assignee: Rockwell International, Seal Beach, Calif.

[21] Appl. No.: 281,949

[22] Filed: Jul. 28, 1994

[51] Int. Cl.[6] ..... H01F 21/08

[52] U.S. Cl. ..... 336/155; 336/12; 336/83

[58] Field of Search ..... 336/155, 212, 336/174, 188

[56] References Cited

U.S. PATENT DOCUMENTS

| | | | |
|---|---|---|---|
| 3,848,209 | 11/1974 | Lee et al. | 336/188 |
| 4,129,820 | 12/1978 | Brock | 336/12 |
| 4,665,357 | 5/1987 | Herbert | 323/361 |
| 5,450,052 | 9/1995 | Goldberg et al. | 336/83 |

OTHER PUBLICATIONS

S. Kirli, K. Ngo, W. Polivka & M. Walters, "Inductance Modeling For A Mode–2 Perforated–Plate Matrix Inductor/Transformer" IEEE 93CH3293–8, pp. 1130–1136.

U.S. Patent Application S/N 08/169,083, Filed Dec. 1993, Goldberg et al, "Magnetically Variable Inductor For High Power Audio and Radio Frequency Applications" Assigned to Rockwell International Corporation.

*Primary Examiner*—Leo P. Picard
*Assistant Examiner*—G. R. Lord
*Attorney, Agent, or Firm*—Kyle Eppele; M. Lee Murrah; G. A. Montanye

[57] ABSTRACT

An electro-magnetic device for use in applications requiring low-profile components. The device includes a magnetic substrate with a scheme of through-holes in association with a first and second winding, plated or wired, integral to the substrate and wound orthogonal to each other. The first winding comprises the AC inductor/transformer permeability. The second winding in association with an applied DC bias current causes the permeability to vary over a wide controlled operating range.

16 Claims, 3 Drawing Sheets

FIG. 1
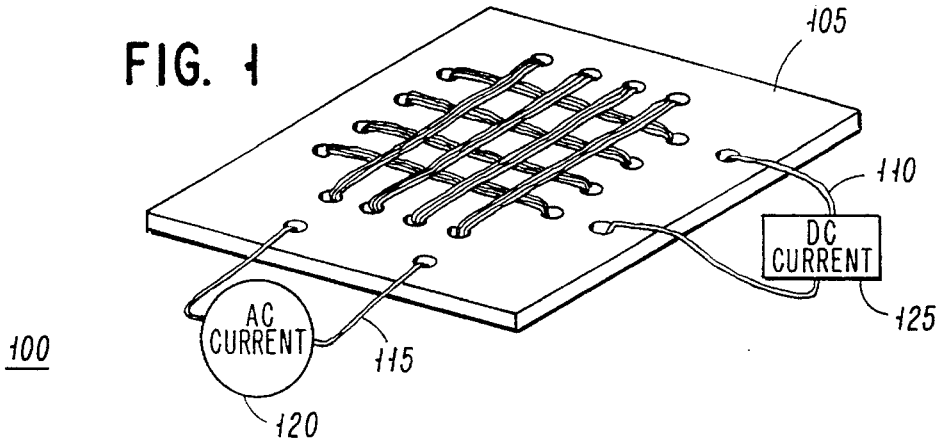
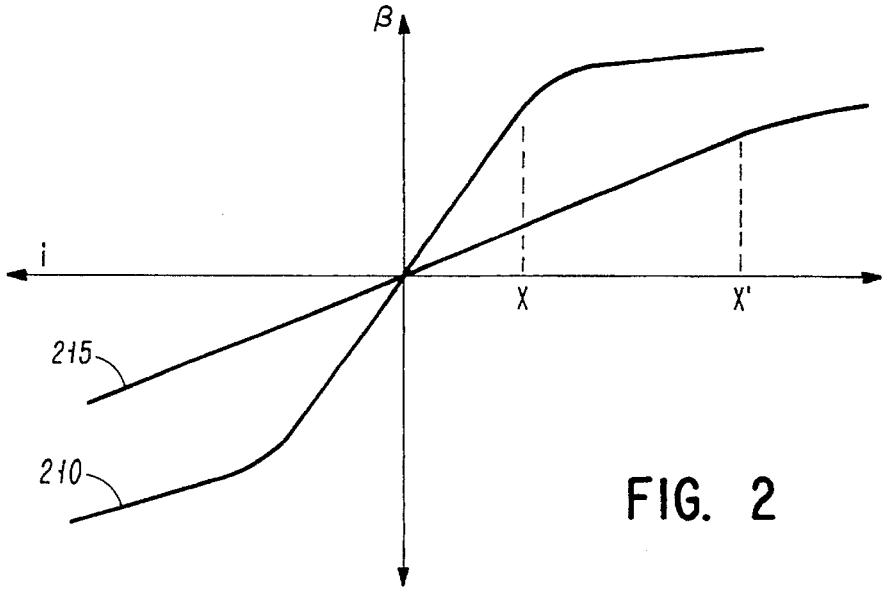
FIG. 2
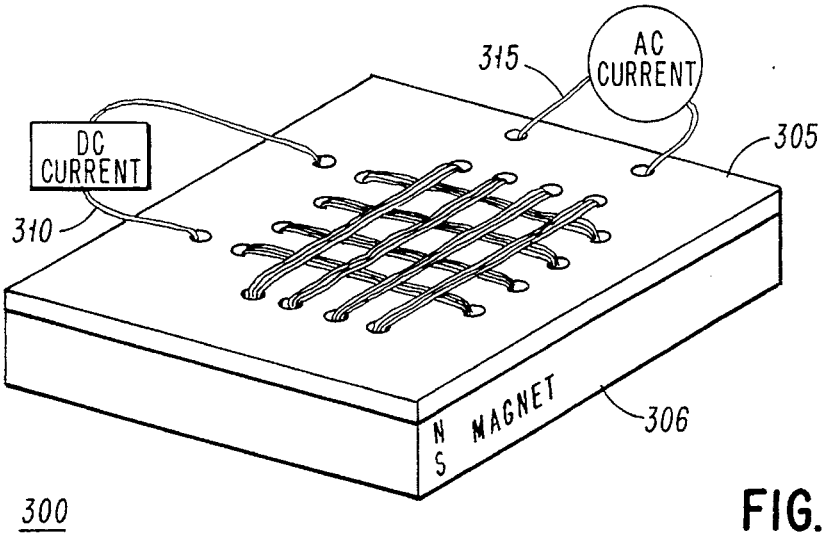
FIG. 3

600

500

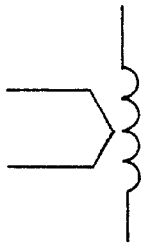
FIG. 4A
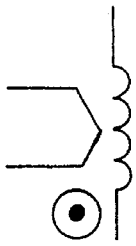
FIG. 4B
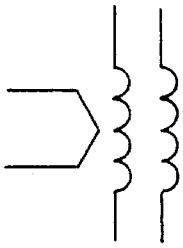
FIG. 4C
FIG. 7
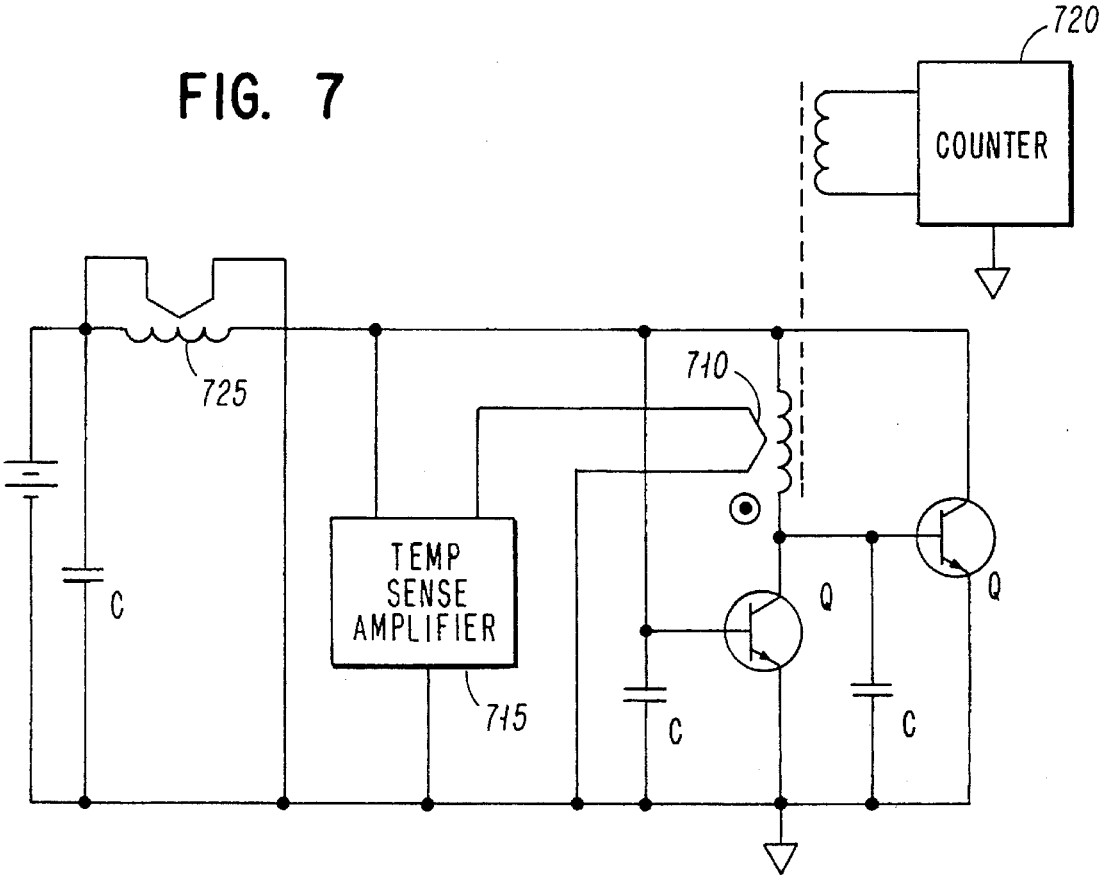

ORTHOGONAL-FIELD ELECTRICALLY VARIABLE MAGNETIC DEVICE

BACKGROUND OF THE INVENTION

The present invention relates to magnetic materials, and more particularly to electronic components having magnetic cores.

Numerous modern-day electrical circuits utilize magnetic core components in accomplishing desired objectives. Audio and alternating current (AC) transformers and inductors typically consist of iron, powdered iron, or ferrite magnetic substrates. While the precise composition of such substrates varies with respect to design goals, common form structures take the shape of rods, toroids, or pots having a primary winding coil and a secondary winding coil integral thereto. The windings are often parallel with respect to generated magnetic fields and define permeability and the operating parameters of the device. Such structures are typically bulky and physical dimensions often define the minimum size requirement of associated devices or subsystems.

Recently, low-profile substrates have become more popularly known, often taking the form of a matrix device of numerous beads or a flattened monolithic substrate with vias or through holes for plated or hard wire windings. One example of such a device may be found in U.S. Pat. No. 4,665,357, issued to Mr. Edward Herbert and incorporated herein by reference. The initial use of low-profile perforated plates for magnetic substrates was hampered, in part, to inaccuracies in modeling the inductance of such devices. Conventional modeling approaches proved inaccurate in light of the non-conventional structure which included magnetic material in the winding window. Although numerous combinations of hole patterns, conductor paths, and core compositions were possible, empirical formulas have been devised and published addressing such modeling issues. One such publication is a paper entitled "Inductance Modeling For A Mode-2 Perforated-Plate Matrix Inductor/Transformer", by S. Kirli, K. D. T. Ngo, W. M. Polivka, and M. M. Walters, IEEE Annual Power Electronics Specialists Conference 1993, pages 1131–1136.

Simultaneous to the continued development of improved low-profile inductors and transformers, solenoid type variable inductors eliminating external magnets and associated circuitry of previous devices were also improved. A permeability function based upon an RF signal in a first winding, and a perpendicular control signal in a second winding has been disclosed as an improved variable solenoid inductor. To such end, application Ser. No. 08/169,083, having the same assignee as the present disclosure is directed to such improvements and is incorporated herein by reference.

Consequently, there exists a need for a low-profile inductor of high reliability, fast operating speed and low cost.

SUMMARY OF THE INVENTION

The present invention provides an apparatus and method for accomplishing controllable magnetic inductance and transformation. By utilizing inherent advantages of orthogonal flux fields. A low-profile electro-magnetic device can be constructed that minimizes size restrictions of associated subsystems, while simultaneously providing a highly reliable device. In one embodiment of the present invention a thin, rectangularly shaped, selectively-perforated substrate provides maximum volume of ferrous material and supports the primary, secondary and orthorary windings that produce magnetic fields having resultants perpendicular to each other in response to an AC input signal and a DC biasing control signal. The control flux of the DC biasing signal is provided by the orthorary winding. The subsequent induction of the apparatus is instantaneously determined by the orthogonal magnetic field values.

Further, the maximizing of surface area provides a means for attaching all of the electronic control circuitry required to implement complete power converters on a multi-chip module hybrid integrated circuit substrate.

A preferred embodiment of the above described apparatus is comprised of a low-profile core of manganese-zinc ferrite composition with copper plated through wires or copper wires deposited in accordance with deposition photoresistive techniques, which insulate subsequent wire layers from each other while providing a plurality of windings, die attach pads and associated interconnects within a highly confined area.

It is an object of the present invention to provide a variable low-profile electro-magnetic device.

It is yet another object of the present invention to provide an electro-magnetic device in accordance with high volume production techniques.

It is yet another object of this invention to provide miniaturized magnetically controlled electronic circuitry capable of providing such functionality as DC/DC conversion of various topologies; EMI filtering; adaptive filtering; tunable voltage/current controlled oscillators; control loop ground isolation; and temperature compensated sensors.

It is a feature of the present invention to utilize characteristics of perpendicular magnetic field forces.

It is another feature of this invention to maximize the material volume and hence the storage capacity of inductance via the minimization of thru-holes.

It is yet another feature of this invention to minimize thru-holes, thus maximizing magnetic volumes of this invention even further.

It is an advantage of the present invention to provide a fast switching variable inductor.

It is another advantage of the invention to provide a packaging means for incorporating all the electronic control and sense circuitry integral to the surface of the controlled magnetic device(s).

It is another advantage of the present invention to provide a variable inductor with enhanced reliability.

It is yet another advantage of the present invention to provide a variable inductor with low leakage in ample, inexpensive implementation.

It is another advantage of the invention to provide a significant surface to allow easy application of a third influencing but independent flux which is in a direction perpendicular to both of the other fields present in the ferrite substrate of this invention.

These and other objects, features, and advantages are disclosed and claimed in the specification, figures and claims of the present application.

BRIEF DESCRIPTION OF THE DRAWINGS

FIG. 1 is a perspective view of one embodiment of an inductor implementing the teachings of the present invention.

FIG. 2 is a magnetization curve of a given material with and without the presence of a DC biasing current.

FIG. 3 is an alternate embodiment of an inductor implementing the teachings of the present invention.

FIGS. 4A, 4B and 4C are depictions schematic symbols utilized for orthorary winding representations.

FIG. 7 is a schematic diagram of a temperature compensated sensor circuit incorporating the teachings of the present invention.

DETAILED DESCRIPTION

Figure 6:
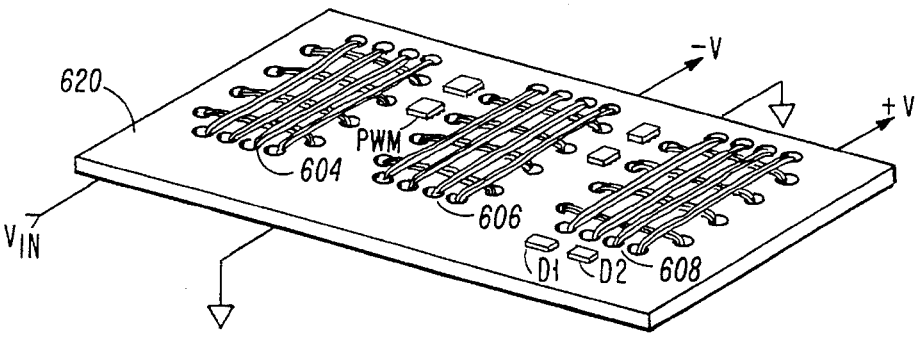
FIG. 6 is a schematic diagram of the power converter of FIG. 5.

Turning now to the drawings, wherein like items are referenced as such throughout, FIG. 1 illustrates a perspective view of one embodiment of an electro-magnetic device (as used herein), here an inductor 100 that incorporates the teachings of the present invention. The low-profile variable inductor 100 is but one of many variations of an inductor or transformer that could benefit from the current disclosure and is chosen only as an example configuration. A substrate 105, such as a perforated plate, is shown having two parallel rows of round holes or apertures of approximately the same size. Each opening in substrate 105 provides for the passing of wires 110 and 115 which comprise the "windings" of the inductor 100. As shown, wire 115 comprises the primary winding of the inductor 100 and is electrically coupled to an alternating current (AC) input signal source 120. The orthorary winding of the apparatus 100 is provided by wire 110 which is coupled to a direct current (DC) source 125.

The physical dimensions of the substrate 105 can assume any length, height, or width value as deemed necessary by the specific design. Height dimension values as little as 0.025 inch are possible, dependent upon precise manufacturing techniques used in assembling the inductor (wired or plated windings). Destined operating environment temperature may also affect the substrate thickness.

Winding wires 110 and 115 were of copper composition, but could be of any suitable conductor material. Alternatively, the "wires" could consist of plated couplings affixed to the substrate 105. The substrate 105 was ferrite manganese-zinc, however, any known composition such as nickel-zinc, or other ferrous composites, such materials would also benefit from the teachings of this disclosure.

The operation of device 100 will now be described. An AC signal coupled through the primary winding 115 provides permeability of the inductor 100. By varying a DC input signal through the orthorary winding 110, the permeability functionality of the first winding is caused to vary over a wide operating range, as illustrated in FIG. 2.

FIG. 2 illustrates a representative enhancement afforded by utilizing the present invention in graphic form. The vertical axis is assigned the flux density measurement B while the horizontal axis is assigned to the applied force or current i. The curve designated as 210, represents a typical permability plot of an electro-magnetic device of the prior art. As the permeability of the device approaches the point x, the slope of the curve transitions to a non-linear region denoting "saturation" of the underlying device. Hence, the region represented by the intersection of the B and i axis to x is the useful portion of the device for the vast majority of applications. By now looking at the curve designated as 215 the effects of the orthorary field are dramatically illustrated. For a approximately equivalent device (in terms of dimensions and operating characteristics), the application of the desired region, point of axis intersection to x', is greatly increased. The increased region, x to x', is attributable to the orthorary winding as described above (and/or a transverse magnetic field as will be described in FIG. 3).

FIG. 3 illustrates an alternate embodiment of the present invention in which the use of a permanent magnet 306, of desired polarity, is located adjacent to the apparatus in FIG. 1. The presence of the flux field created by the permanent magnet 306 serves to favorably alter the magnetization profile of the device 300, in a similar fashion to the presence of the DC control current illustrated in FIG. 2. Inclusion of the permanent magnet 306 allows one the flexibility of utilizing a lower power consuming DC voltage source or extending the gain range provided by altering the magnetization curve. The permanent magnet 306 is shaped in such manner as to provide clearance for the windings between plate 305 and itself.

A key factor of the inductor 300 is that the device inductance is controlled by the DC current supplied to the orthorary winding (wire 315) which is perpendicular to the primary inductance windings resultant magnetic field. This relationship of the primary and orthorary winding magnetic fields minimizes induction of the AC input signal on the DC control source signal. Additionally, in the case of plated transformers the turn ratio can be provided over a broad range of complex number relationships, thereby providing precise inductance resolution of the inductor.

Although depicted as a plate having two wires, it is also possible, practical and well understood that the "wires" may be plated onto a substrate by the use of deposition manufacturing techniques. The use of such thin film or thick film processes allows for miniaturization of the device, of exponential magnitude, with respect to common electro-magnetic device structures.

FIGS. 4A, 4B and 4C are schematic symbols, introduced and herein defined by the Applicant to represent orthorary windings as depicted in FIGS. 1 and 3, respectively, and to further include such a structure with secondary windings.

Figure 5:
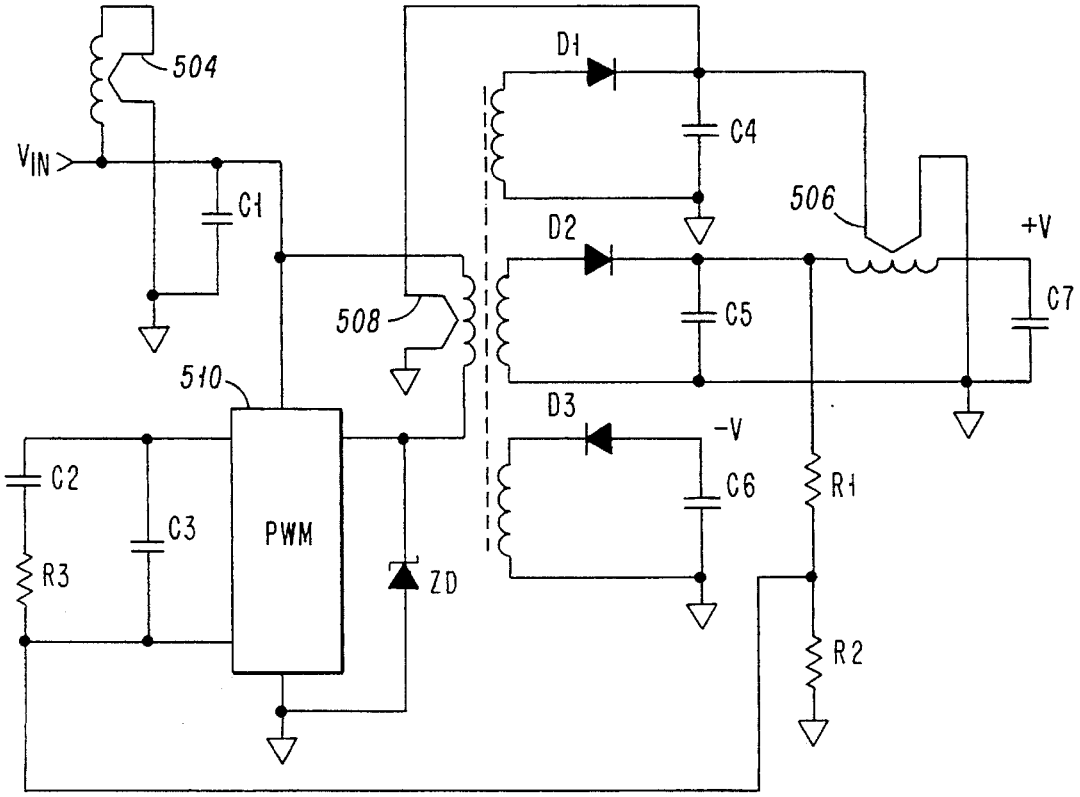
FIG. 5 is a power converter incorporating the teachings of the present invention.

FIG. 5 illustrates a schematic diagram of one application, a converter 500 incorporating the teachings described above. A DC signal, $V_{IN}$ is coupled to orthorary windings 504, 506 and 508. Additional current control devices, resistors, capacitors and diodes, (R1–R3, C1–7, D1–3, ZD) are coupled in conjunction a pulse wave modulator 510 to accomplish the conversion function.

FIG. 6 is a perspective view of one embodiment of the schematic of FIG. 5. A thin monolithic plate 620 serves as the substrate component for each of the orthorary windings 604, 606 and 608 as well as providing a substrate for the current controlling devices.

FIG. 7 depicts an alternate application, a temperature compensated pressure sensor schematic drawing that incorporates the teachings of the present invention. In a similar fashion to the converter of FIGS. 5 and 6, the apparatus of FIG. 7 may be implemented on a single monolithic plate with all accompanying current devices and windings attached thereto. A temperature sensor 715 detects changes in the ambient temperature via an output electrical signal and maintains the output frequency of the oscillator 710 invariant with ambient temperature changes, thereby improving the accuracy of the underlying measurement, herein pressure. The oscillator 710 frequency output is then kept constant in response to changes in the ambient temperature and is calibrated by a memory means (not shown) thereby providing a reliable integrated temperature compensated pressure sensor. It is also understood that numerous other applications, such as position or velocity detectors, could also benefit by utilizing the concepts of the present invention.

Those skilled in the art will readily recognize that various modifications and changes may be made to the present invention without departing from the true spirit and scope thereof which is set for in the following claims.

I claim:

1. An electro-magnetic device comprising:

a low-profile magnetically permeable substrate;

a first set of windings, magnetically coupled to the substrate having a first resultant force with respect to an alternating current input signal; and, a second set of windings, magnetically coupled to the substrate, having a second resultant force with respect to a direct current input signal that is orthogonal in direction to the first resultant force;

wherein the orthogonal resultant forces alters the permeability of the device, extending its operating range prior to saturation.

2. The apparatus of claim 1, wherein the substrate is of manganese-zinc composition.

3. The apparatus of claim 1, wherein the substrate is comprised of two pairs parallel rows perpendicular to each other having an equal number of apertures for windings.

4. The apparatus of claim 1, further comprising a variable DC current source for providing the direct current input signal.

5. The apparatus of claim 1, wherein the substrate is rectangular shaped.

6. An electro-magnetic device comprising:

a low-profile magnetically permeable substrate;

a first set of windings, magnetically coupled to the substrate having a first resultant force with respect to an alternating current input signal;

a second set of windings, magnetically coupled to the substrate, having a second resultant force with respect to a direct current input signal that is orthogonal in direction to the first resultant force; and a magnet of predetermined polarity coupled to or in close proximity to the substrate, said magnet also producing resultant forces orthogonal to the first resultant force;

wherein the orthogonal resultant forces alters the permeability of the device, extending its operating range prior to saturation.

7. The apparatus of claim 6, wherein the substrate is of manganese-zinc composition.

8. The apparatus of claim 6, wherein the substrate is comprised of two pairs parallel rows perpendicular to each other having an equal number of apertures for windings.

9. The apparatus of claim 6, further comprising a variable DC current source for providing the direct current input signal.

10. The apparatus of claim 6, wherein the substrate is rectangular shaped.

11. The apparatus of claim 10 wherein the primary winding is oriented in a general perpendicular fashion with respect to the longest edge of the substrate.

12. An electro-magnetic device comprising:

a low-profile magnetically permeable substrate;

a first set of windings, magnetically coupled to the substrate having a first resultant force with respect to an alternating current input signal; and, a magnet of predetermined polarity coupled to or in close proximity to the substrate, having a second resultant force with respect to a direct current input signal that is orthogonal in direction to the first resultant force;

wherein the orthogonal resultant forces alters the permeability of the device, extending its operating range prior to saturation.

13. The apparatus of claim 12, wherein the substrate is of manganese-zinc composition.

14. The apparatus of claim 12, wherein the substrate is comprised of two pairs parallel rows perpendicular to each other having an equal number of apertures for windings.

15. The apparatus of claim 12, wherein the substrate is rectangular shaped.

16. The apparatus of claim 12 wherein the primary winding is oriented in a general perpendicular fashion with respect to the longest edge of the substrate.

* * * * *